US005878818A

United States Patent [19]

Hebert et al.

[11] Patent Number: 5,878,818

[45] Date of Patent: Mar. 9, 1999

[54] MECHANICAL SET ANCHOR WITH SLIPS POCKET

[75] Inventors: Joseph V. Hebert, Tomball; John E. Campbell; Thomas F. Bailey, both of Houston, all of Tex.

[73] Assignee: Smith International, Inc., Houston, Tex.

[21] Appl. No.: 85,872

[22] Filed: May 28, 1998

Related U.S. Application Data

[62] Division of Ser. No. 594,492, Jan. 31, 1996.

[51] Int. Cl.[6] ..... E21B 7/08

[52] U.S. Cl. ..... 166/382; 166/117.6; 175/61; 175/81

[58] Field of Search ..... 175/61, 82, 81, 175/80; 166/117.6, 298, 382

[56] References Cited

U.S. PATENT DOCUMENTS

| | | | |
|---|---|---|---|
| 2,103,622 | 12/1937 | Kinzbach | 166/55.3 |
| 2,105,722 | 1/1938 | Barrett et al. | 175/82 |
| 2,882,015 | 4/1959 | Beck | 166/117.6 |
| 3,908,759 | 9/1975 | Cagle et al. | 166/117.6 |
| 4,397,355 | 8/1983 | McLamore | 166/117.6 |
| 5,431,220 | 7/1995 | Lennon et al. | 166/117.6 |
| 5,488,989 | 2/1996 | Leising et al. | 166/117.6 |
| 5,657,820 | 8/1997 | Bailey et al. | 166/117.6 |
| 5,720,349 | 2/1998 | Pleasants et al. | 166/55.7 |

*Primary Examiner*—Hoang C. Dang
*Attorney, Agent, or Firm*—Shawn Hunter; Conley, Rose & Tayon

[57] ABSTRACT

A mechanical set anchor wherein a plunger extending from a base end of an anchor body activates a pin type trigger which releases a spring utilized to set multiple slips extending from the body of the anchor. Continued downward compressive forces fully sets the slips into the borehole pipe casing. The slips are maintained in their fully set position by a locking nut. The slips are further set into the pipe casing after slips are released from the anchor body. The anchor is mechanically released by an upward pull under tension of sufficient strength to shear release pins that release the compressed spring fully retracting the slips within the anchor body so that the anchor may be tripped from the borehole without interference from the previously engaged slips.

14 Claims, 6 Drawing Sheets

FIG. 9
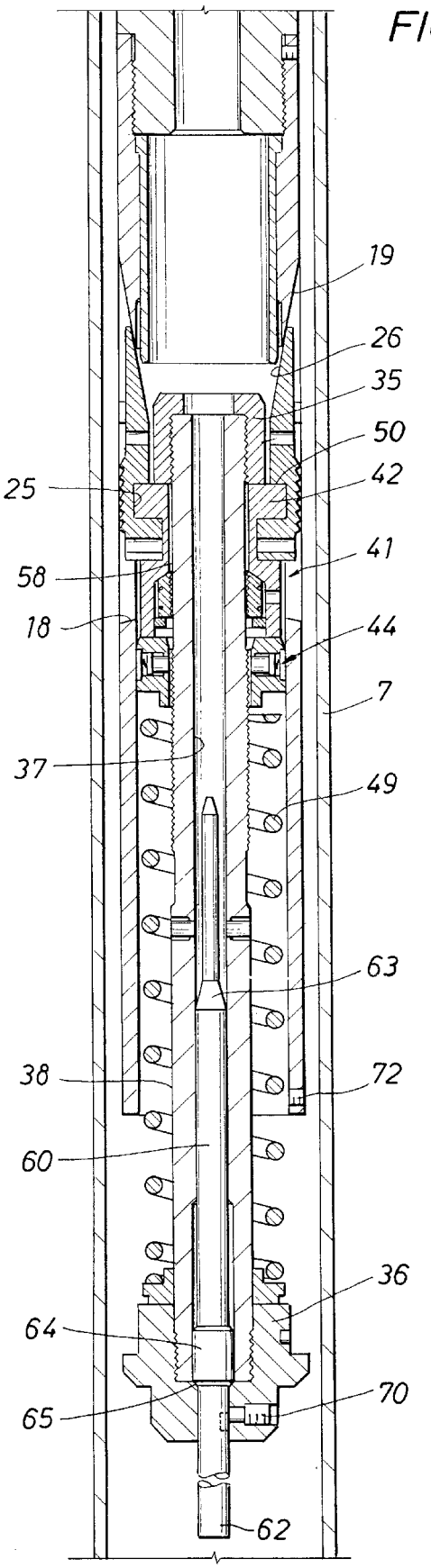
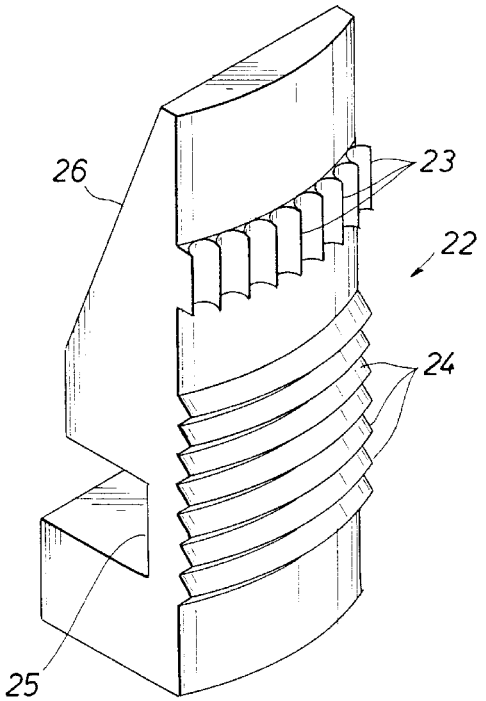
FIG. 10

FIG. 11
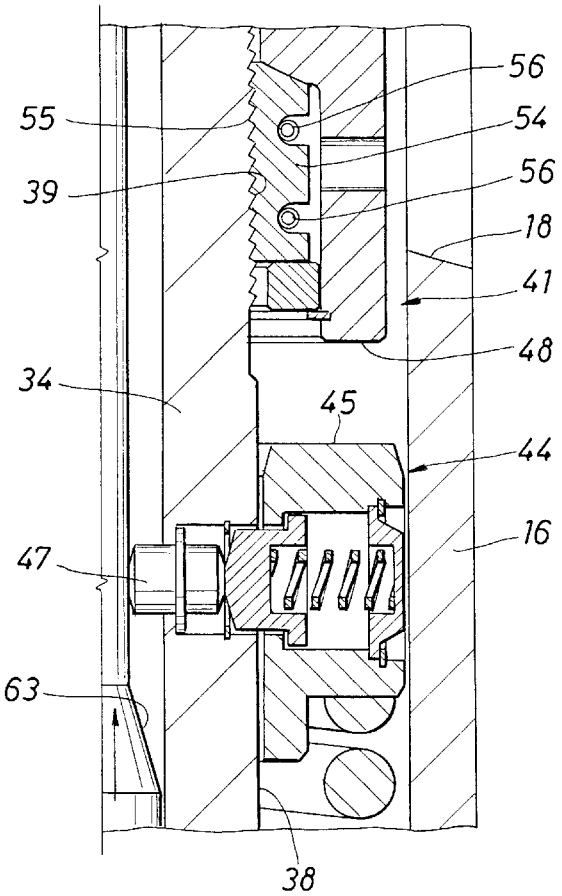
FIG. 12
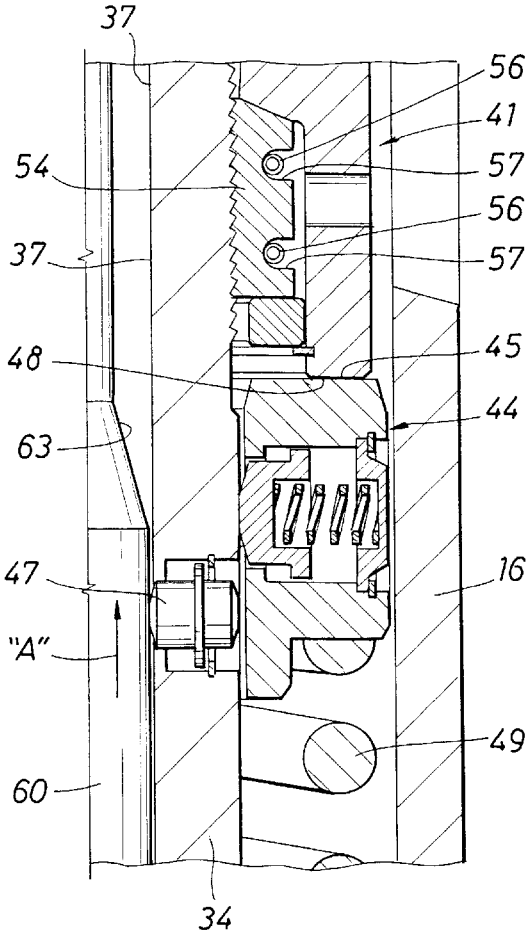
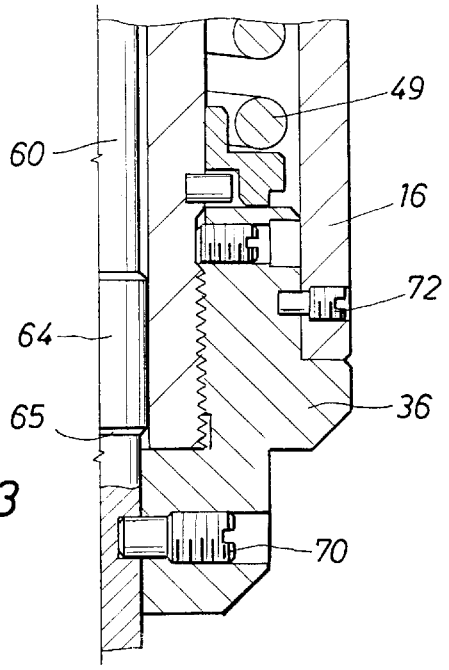
FIG. 13

MECHANICAL SET ANCHOR WITH SLIPS POCKET

This is a divisional of copending application Ser. No. 08/594,492 filed on Jan. 31, 1996.

BACKGROUND OF THE INVENTION

1. Field of the Invention

This invention relates to oil and gas drilling equipment and more specifically relates to a mechanical setting tool apparatus commonly used with a whipstock assembly.

2. Background

It is often desirable to sidetrack (deviate) existing well boreholes for various reasons in producing more economical well bores. It is well known in the industry that whipstocks are used in drilling to direct or deviate a drill bit at an angle from a borehole. The borehole can be cased (lined with pipe casing) or uncased (no pipe casing). More often than not the previously bored hole is cased.

For a cased borehole, a drilling operator will set a cement plug in the borehole that is at least 100 feet deep followed by a packer or bridge plug. A packer may or may not be a complete seal above the cement plug depending upon the circumstances. A bridge plug is a wire line sealing device which is set three to five feet above the casing collar (or joint) near the required point that deviation of the borehole is needed. Of course, wire lines are used with packers as well for orienting whipstocks subsequently tripped into the borehole. The position of the packer or bridge plug and the whipstock is critical because the deviated borehole must not penetrate the casing at or near a casing collar (or joint). The whipstock is traditionally set several feet above the packer or bridge plug. Great care is exercised to coordinate wire line and pipe measurements to assure that the whipstock is clear of the casing collar.

Typically, the complete downhole assembly consists of a whipstock attached to some form of packer mechanism. Presently, there are two conventional whipstock types available. The first type combines a packer with attached whipstock positioned above the packer and the second is a single whipstock assembly with a plunger sticking out the bottom of the downhole tool. The whipstock is the actual oil tool that causes a drill bit to deviate from the original borehole. The packer or setting tool on the first type is another oil tool that holds the whipstock in place once the whipstock has been set in the cased borehole at the desired angle orientation.

On the second type, the plunger releases spring loaded slips when the tool is set down on the packer or bridge plug that is strategically positioned in the cased borehole. The slips hold the tool in place once they are forced against the casing by the released spring. The bottom trip device operates primarily in a cased borehole and it has problems because it only has a single slip or wedge to secure the whipstock in place which may not grip sufficiently to prevent movement of the whip under operating conditions.

A typical whipstock is a triangular shaped tool about 10 to 12 feet long. It is slightly less in diameter than the inside diameter of the pipe casing at its bottom and ramps upwardly to infinity at its top. The back of the tool usually rests against the pipe casing. The tool face is cup shaped or concave in appearance and guides the sidetracking borehole drilling equipment off to the side of the pipe casing in the direction set by the orientation of the ramped tool face. The bottom or base of the whipstock is attached to the packer or setting tool.

A whipstock of the proper diameter is chosen for each cased borehole so that its bottom diameter matches the pipe casing and packer or setting tool. Its top end should match the inside diameter of the borehole casing so that the sidetracking drilling assembly smoothly transitions through a window previously cut into the pipe casing.

Mechanically set anchors typically utilized to support whipstocks have either a one slip holding mechanism or two fixed slips and one moving or activating slip. Often times the holding capabilities of these conventional devices is not enough to prevent slippage or movement during sidetrack drilling operations. Moreover, the foregoing anchors only have load carrying capability in compression since tensional loads will serve to release the slips from their grasp of the pipe casing. In other words, single slip mechanical set anchors do not provide any upward load capability and very little torque capacity.

In addition, these devices are somewhat disadvantaged in that, when they are released from the pipe casing, they will drag against the casing when they are tripped from the borehole because the spring force used to activate the slips is not released.

SUMMARY OF THE INVENTION

It is an object of this invention to provide a mechanically set anchor with multiple slips for use, in cooperation with a whipstock, to sidetrack a cased borehole.

A mechanical set anchor means for use in combination with a whipstock for sidetrack drilling operations consisting of an anchor body forming whipstock attachment means at a first end and mechanical set actuation means extending from a base end of the anchor body. The anchor body further contains at least a pair of moveable slips for engagement with a wall of a borehole or a previously placed pipe casing secured within the borehole when the mechanical set means is actuated. The mechanical set means includes a moveable plunger extending from the base end that telescopes axially into a moveable concentric mandrel contained within the anchor body after the end of the plunger contacts a borehole stop means such as a bridge plug or packer positioned below the mechanical set packer. The body of the plunger forms a means to release a spring biased slip actuation means positioned between the mandrel and the anchor body. The slip actuation means under spring compression is actuated when the plunger reaches a predetermined position thereby driving the pair of slips contained within the anchor body into the wall of the borehole or a pipe casing secured therein.

Once the slips are driven into engagement with the borehole a locking nut prevents the slips from becoming disengaged with the borehole or pipe casing.

A mechanical set release means is also provided to completely retract the slips into the anchor body when tensional forces are applied to the anchor body. Shear pins are sheared when a predetermined tensional load is applied to the anchor body allowing the mandrel and locking nut means to move downward as the spring compression forces are released. As the locking nut means moves downward, the slips begin to retract, loosening their grip with the borehole. A shoulder formed on an upstream end of the mandrel holds the retracted slips within the anchor body when the mandrel moves toward the base of the anchor body to assure that the retracted slips remain within the confines of the anchor body when the mechanical set anchor and whipstock is tripped out of the borehole.

Upon reaching a setting depth in a cased borehole, a plunger extending from a base or bottom end of the anchor body activates a pin type trigger which releases a spring utilized to set the multiple slips. Continued downward weight or force fully sets the slips into the borehole pipe casing. The slips are maintained in their fully set position by a locking nut.

The slips provide very large load bearing capability in the downward direction and significant load carrying capacity in the upward direction, contrary to conventional mechanically set anchors as heretofore mentioned.

The anchor of the present invention is mechanically released by an upward pull of sufficient strength to shear release pins that release the compressed spring. Upon release, the slips fully retract within the body of the mechanically set anchor when the slip actuation means engages the base of each slip as the mandrel moves down the anchor body. Hence the actuation plunger serves to both engage the slip actuation spring for driving the slips against the pipe casing at the start of the setting sequence when the plunger is telescoped into the anchor body and to release the slips upon an upward pull of the drill string when the spring retention shear pins are ruptured and the mandrel is moved downward in the anchor body when being retrieved. A shoulder extending from the slip actuation ring engages the base of the slips thereby retracting the slips within the anchor body. Thus, when the anchor is tripped from the cased borehole, the slips will not protrude from the anchor body and drag against the pipe casing or borehole walls as the assembly is moving up the borehole.

An advantage then of the present invention over the prior art is that the mechanically set anchor provides load capability under both compression and tension.

Another advantage of the present invention over the prior art is that the anchor provides excellent torque capability (resists torque) during milling and drilling operations.

Yet another advantage of the present invention over the prior art is that the mechanically set anchor has a locking nut that maintains the set on the slips once they engage the pipe casing.

Still another advantage of the present invention over the prior art is that the anchor has multiple slips which centralize the anchor within the pipe casing and provide superior holding power.

The above noted objects and advantages of the present invention will be more fully understood upon a study of the following description in conjunction with the detailed drawings.

BRIEF DESCRIPTION OF THE DRAWINGS

FIG. 9 is a cross-section of the anchor illustrating the slips completely retracted within the anchor body housing.

FIG. 10 is a perspective view of one of the slips showing the radially and axially aligned protrusions that, when engaged with the borehole casing, prevent torsional motion as well as axial motion during sidetrack drilling operations.

FIG. 11 is an enlarged cross-sectional view of the slip actuation mechanism in the retained position.

FIG. 12 is an enlarged cross-sectional view of the slip actuation mechanism in the released position, the slip actuation mechanism drives the slips into engagement with the borehole casing through the compressed spring.

FIG. 13 is an enlarged cross-sectional view of the compression spring anchoring device.

DESCRIPTION OF THE PREFERRED EMBODIMENTS AND BEST MODE FOR CARRYING OUT THE INVENTION

Figure 1A:
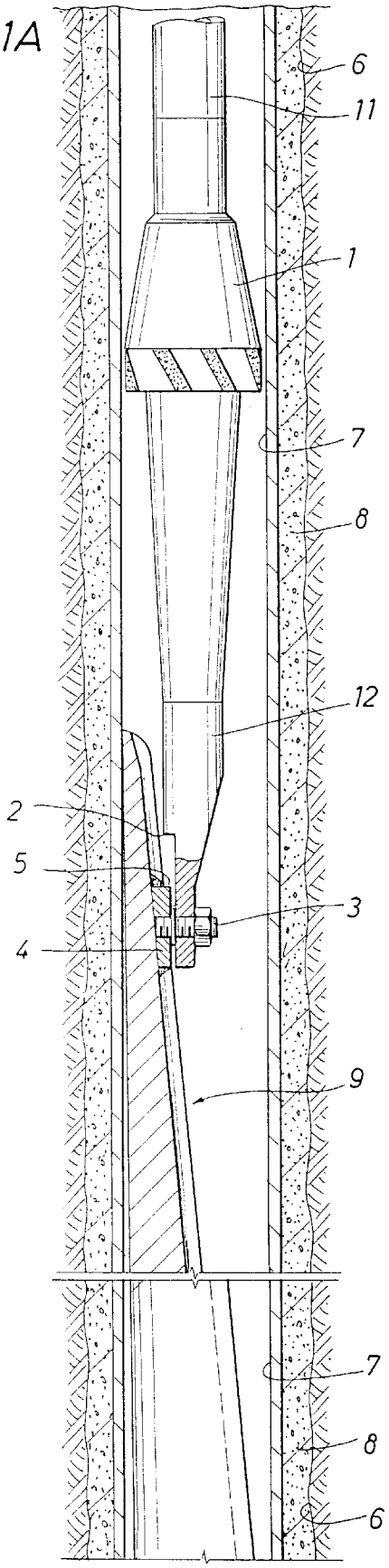
FIG. 1A is a partially cutaway view of a mechanical set anchor and attached whipstock prior to anchoring the mechanical set anchor within a cased borehole.
Figure 1B:
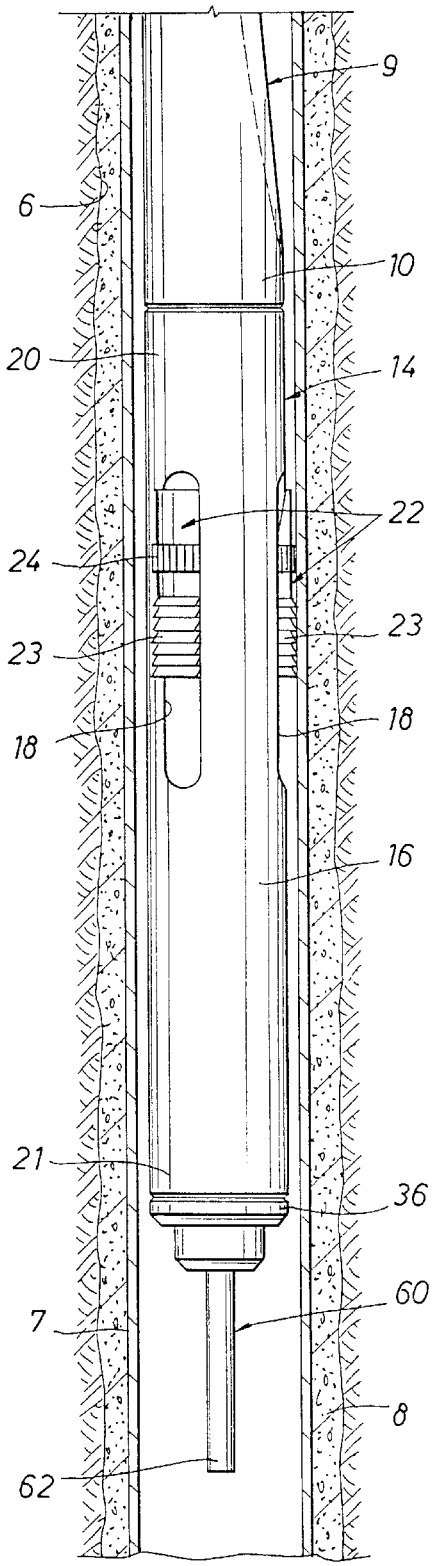
FIG. 1B is a continuation of FIG. 1A illustrating the mechanical set anchor with the slips in a retracted position.

Referring now to FIGS. 1A and 1B, a sidetracking assembly may, for example, include a starter mill 1 threadably connected to a drill string 11, a whipstock generally designated as 9 and a mechanically set anchor, generally designated as 14.

The sidetracking assembly is lowered or tripped into a borehole 6 by the drillstring 11 to a predetermined depth that preferably includes a portion of the borehole that is lined with a steel casing 7 that is cemented in place (8). The lower end 12 of the window starter mill 1 is connected to the top end of the whipstock 9 through a shear bolt 3 that is threaded into shear bolt block 4 affixed to the ramped face of the whipstock. A ledge 2 is formed in the side near the end 12 of starter mill 1 that is designed to strike shoulder 5 formed by shear bolt block 4 after the shear bolt is sheared.

The ledge 2 formed in the starter mill 1 and the shoulder stop 5 of shear bolt block 4 serve three very important purposes. The first purpose is to assure that the starter mill 1 will not become wedged between the whipstock face and the pipe casing 7 after the shear bolt 3 breaks possibly resulting in a disastrous release of the whipstock and anchor. Without the stopping action of the ledge 2 against shoulder 5 of the present invention, prior art starter mill whipstock assemblies have resorted to shear bolts with relatively weak breaking points to prevent the starter mill from becoming jammed against the casing and whipstock. An obvious result of the low shear strength of the bolt is that the state of the art anchor is not securely set within the borehole.

The ledge 2 and shoulder stop 5 featured in the present invention will not allow the starter mill 1 to move past the shear bolt block 4.

The second purpose is to allow the use of a shear bolt with a much higher shear strength property (up to 20 times the shear strength of the forgoing prior art shear bolt). The higher shear strength of the shear bolt 3 allows for the use of much heavier drill string weights to be subjected to the mechanical set anchor 14 resulting in a much better "set" of the slips 22 within the pipe casing 7. Moreover, a higher strength shear bolt may be used without fear that the starter mill 1 will become jammed against the whipstock 9 when the bolt shears because the end of the mill 12 will again, be stopped against the shear bolt block 4.

The third important purpose is to use the innovative ledge and shoulder feature of the present invention to force the mechanical set anchor into even tighter engagement with the pipe casing. For example, when the shear bolt 3 fractures, the ledge 2 on the end 12 of the starter mill 1 strikes the shoulder 5 of shear bolt block 4 with considerable force further seating the anchor 14 within the pipe casing 7.

As a matter of fact, after the starter mill is freed from the end of the whipstock, it is common practice by drill rig operators to lift the drill string / starter mill off the shoulder 5 of bolt block 4 (a foot or so) without rotation and drop the drill string and starter mill so that the mechanical set anchor is further hammered in place with the pipe casing 7.

FIG. 1B illustrates the lower end 10 of the whipstock 9 threadably engaged with the upper end 20 of housing 16 of the mechanically set anchor generally designated as 14. The housing contains, for example, three anchor slips generally designated as 22 that are actuatable in and out of the housing 16 through three axially aligned slots 18 positioned about 120 degrees apart. A multiplicity of radially aligned engagement "threads" 23 and axially aligned "fins" 24 extend from the outer surface of each of the slips and are designed to resist torsional as well as axial loads imposed on the mechanical set anchor during sidetrack drilling operations. The lower end 21 of the housing 16 supports a base cap 36 from which a central mandrel 34 is attached. A plunger, generally designated as 60, protrudes from the end of the housing 16. The plunger 60 translates or telescopes into and out of the housing 16 and is slidably retained within the central mandrel 34 concentrically retained within the housing (see FIGS. 2, 3, 4, 7, 8 and 9).

With reference now to the cross-section of FIG. 2, the mechanical set anchor 14, in the unactuated state, is shown suspended below the whipstock 9 within the steel casing 7 of the borehole 6. The plunger 60 is in its fully extended state protruding from end cap 36 of lower housing 21.

The enlarged diameter portion 64 of the plunger forms a stop shoulder 65 that retains the plunger within the housing. The plunger 60 further forms a conical surface 63 that serves to release a slip actuation ring generally designated as 44 after the plunger telescopes into mandrel 34 a predetermined distance (see FIG. 3). A shear pin 70 through end cap 36 holds the plunger in the extended position during the trip into the borehole to prevent inadvertent actuation of the mechanical set anchor during a transition period while tripping into the borehole.

Figure 2:
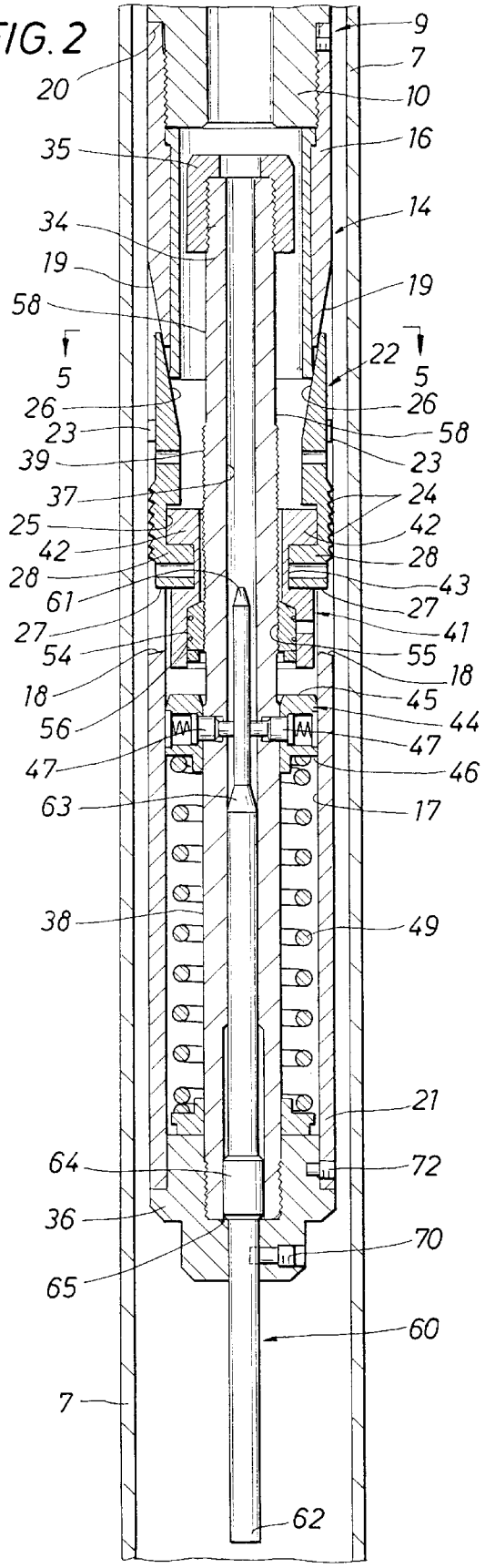
FIG. 2 is a cross-section of the mechanical set anchor illustrating the plunger in the extended position.
Figure 3:
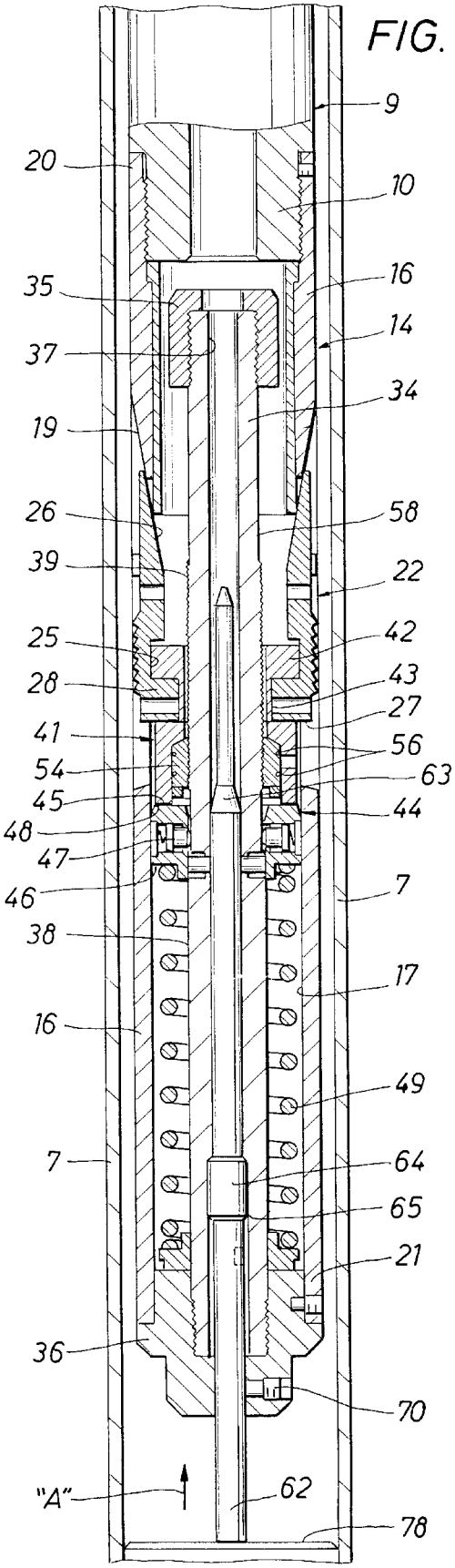
FIG. 3 is a cross-section of the anchor partially actuated, the plunger being telescoped into the anchor body after contacting the bridge plug or packer.

Referring to both FIGS. 1A, 1B and 2, when end 62 of the plunger 60 strikes a bridge plug or packer assembly 78, shear pin 70 is sheared allowing the plunger to move into mandrel 34. The conical surface 63 forces the spring loaded slip actuation drive ring retainers 47 radially outwardly within their sleeves formed in mandrel 34 thereby releasing the drive ring 44 which in turn, strikes the slip drive ring generally designated as 41 into base 27 of each of the slips 22. A coil spring 49, under compression, is contained within an annulus formed between the interior walls 17 of housing 16 and exterior surface 38 of mandrel 34. Spring 49 is compressed between end cap 36 and end surface 46 of the slip actuation ring 44. The slip actuation ring contact surface 45 strikes the end 48 of the slip drive ring 41 which in turn pushes against the base surface 27 formed by each of the slips 22 thereby driving the slips through each of the slots 18 in housing 16. The ramped surface 26 formed by the slips are driven up the conical ramp surface 19 formed by housing 16 thus forcing the slips 22 into engagement with the steel pipe casing 7 thereby anchoring the mechanical set anchor in place within the cased borehole.

Further downward compression force exerted by the drill string after the slips 22 are set in the casing 7 shears the shear bolt 3 freeing the starter mill 1 from the whipstock 9. The ledge 2 formed on the end of the starter mill 1 subsequently strikes the shoulder 5 of the shear bolt block 4 with a great deal of force further setting the slips into the steel pipe casing 7 resulting in a more secure anchor for the mechanical set anchor assembly 14 (as heretofore described).

A segmented lock nut 54 is contained within the drive ring 41. The lock nut, for example, is formed in three 120 degree segments. The inside diameter of each of the segments contain a multiplicity of threaded, radially extended rings 55 that are biased to hold and lock the lock nut 54 in one direction only. The rings 55 engage a multiplicity of identically biased rings 39 formed in the outside surface 38 of mandrel 34.

A pair of, for example, garter springs 56 contained within grooves 57 formed in the outside surface of the stop nut 54, assure that the segments remained locked within the slip retention rings 55 and 39 formed between the segmented nut 54 and the mandrel 34 (see enlarged FIG. 12). As the slips 22 are driven upwardly and radially out of the housing 16, the stop nut segments skip over the rings 39 formed in the mandrel 34, following in the direction the slips are being driven, securely locking the slips tightly into engagement with the pipe casing 7. The segmented nut 54 cannot reverse direction due to the angulation of the cooperating threads 55 and 39 formed in the nut segments and the mandrel 34.

Figure 4:
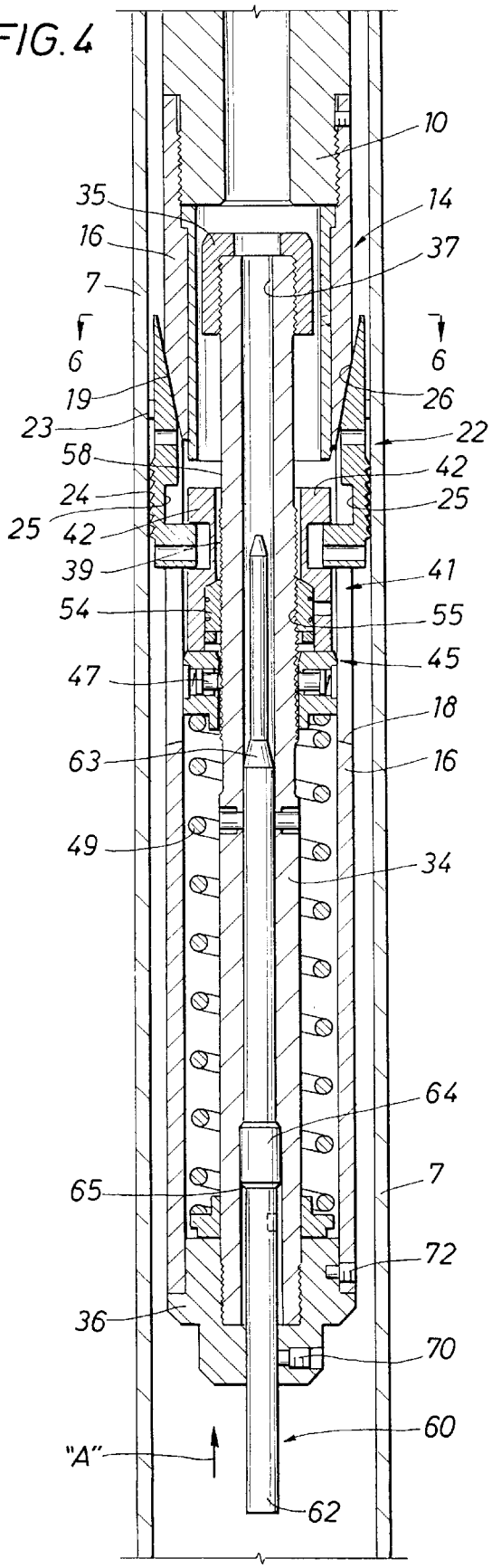
FIG. 4 is a cross-section of the anchor after the slips are set against the cased borehole.
Figure 5:
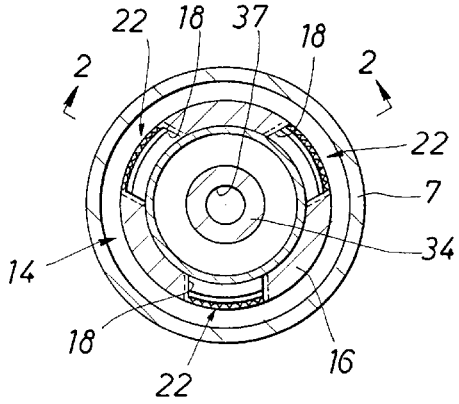
FIG. 5 is a section taken through 5—5 of FIG. 2.
Figure 6:
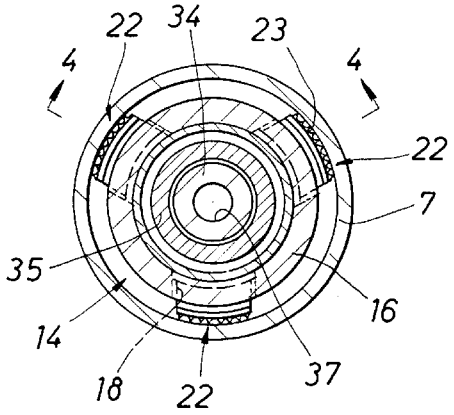
FIG. 6 is a section taken through 6—6 of FIG. 4.

With reference now to FIGS. 4, 5 and 6, the cross-sections illustrate the mechanical set anchor 14 fully engaged with pipe casing 7. The slip actuation drive ring 44, drive ring 41 and segmented lock nut 54 are advanced by the spring 49 upwardly in direction "A" over the angled threads 39 formed on mandrel 34 driving the ramped surfaces 26 of slips 22 over the ramps 19 formed in housing 16, fully engaging fins 23 and rings 24 formed by slips 22 with the pipe casing 7. Again, the segmented lock nut 54 prevents the slips 22 from becoming disengaged with the pipe casing 7 and also prevents the slips from being retracted within the housing prematurely.

The cross-section of FIG. 5 (taken through 5—5 of FIG. 2) illustrates the slips 22 fully retracted Within the housing 16. FIG. 6 taken through 6—6 of FIG. 4 show the slips 22 in full contact with the pipe casing 7.

Figure 7:
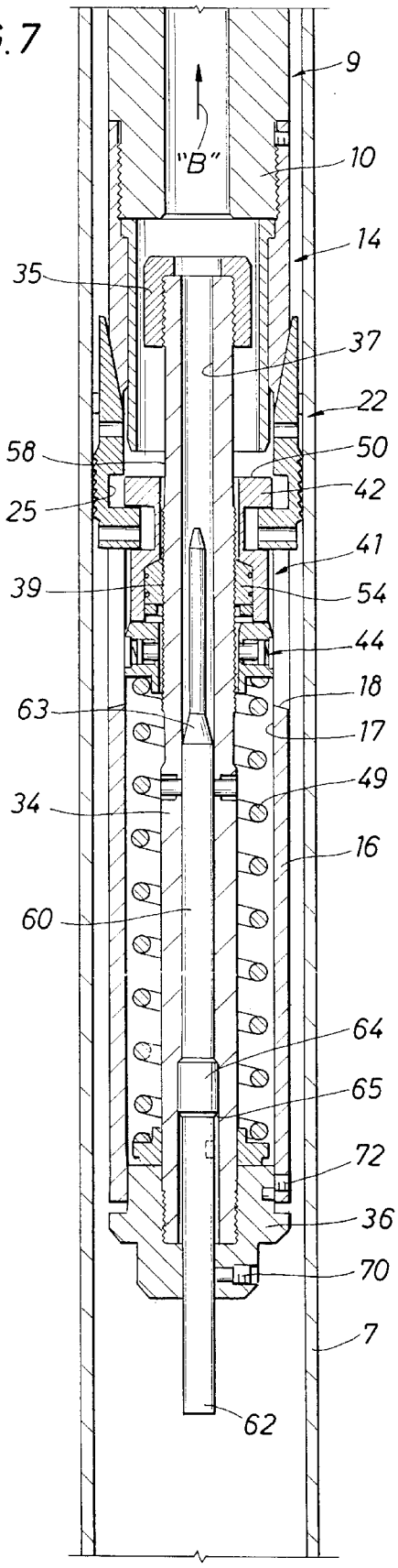
FIG. 7 is a cross-section of the mechanical set anchor in the release mode wherein the spring compression forces are released.
Figure 8:
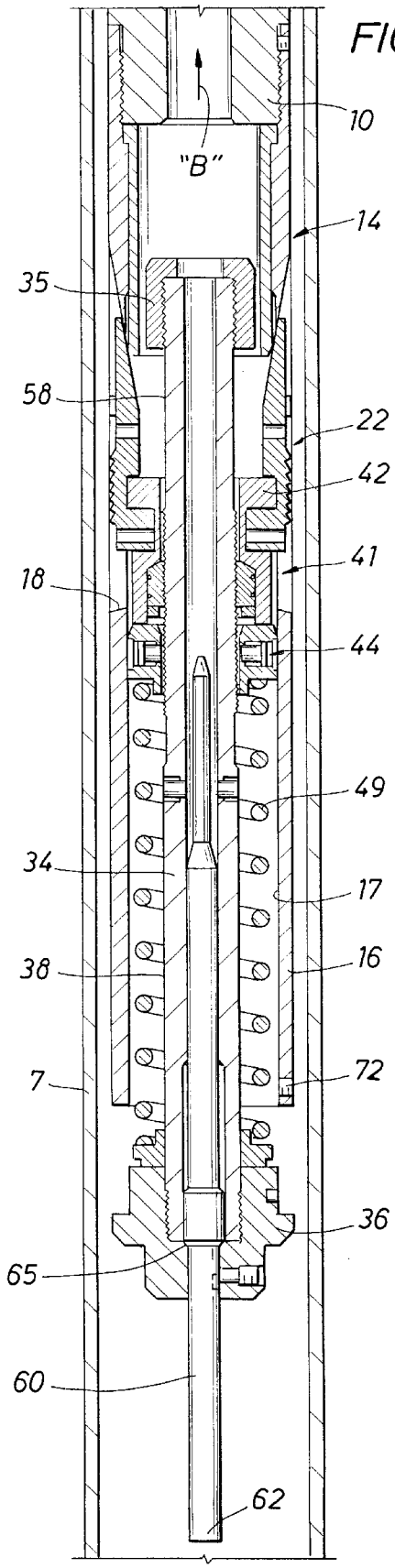
FIG. 8 is a cross-section of the anchor as it progresses through the release mode.

FIGS. 7, 8 and 9 illustrate the slip retraction sequence that prepares the mechanical set anchor 14 and its attached whipstock 9 for removal from the borehole 6.

To start the retraction sequence, the tapered end of the whipstock is captured and pulled upwardly in direction "B" (FIG. 7), subjecting the mechanical set anchor housing 16 to tensional loads (not shown). A predetermined force under tension shears shear pin 72 holding the lower base cap 36 and the mandrel 34 to the end of the housing 16 thereby releasing the spring 49 under compression. Simultaneously, the plunger 60 is driven out of the mandrel 34 when it reacts to the upward pull exerted by the drill string. This in turn releases the slips 22 from the casing 7. Even though the spring is released through separation of the end cap 36 from the housing 16, the spring still has enough compression force to drive the segmented lock nut 54 over the rings 39 formed in the mandrel into the non-threaded smooth segment 38 of the mandrel 34 after the slips become disengaged with the casing 7. The enlarged portion 64 of plunger 60 comes in contact with end cap 36 at shoulder 65 further moving the mandrel 34 and end cap 36 out of the housing 16. Upper end cap 35 of mandrel 34 contacts the drive ring 41 at contact surface 50 thus locking the slips 22 within the housing after the drive ring pulls the three slips 22 into the confines of the housing 16 through engagement of slip retention shoulder 42 of drive ring 41 with annular groove 25 formed in each of the slips 22.

The double action of the force under tension of the drill string coupled with the opposite force of the plunger acting upon the end caps 36 and 35 of attached mandrel 34 assures that the slips are fully retracted within housing 16 for ease of tripping the whipstock and mechanical set anchor out of the borehole.

FIGS. 7, 8 and 9 sequentially illustrate the slip retraction process.

The perspective view of FIG. 10 shows one of the three slips 22 clearly illustrating the multiple radially extending rings or threads 24 and the axially aligned extended fins 23 positioned above the rings. Each of the slips are captured in the annular channel 25 by shoulder 42 of slip actuation ring 41 during the slip retraction process as heretofore described.

FIGS. 11 and 12 are enlarged segments illustrating the slip actuation drive ring 44 and the spring loaded ring release mechanism 47. As the plunger conical surface 63 moves past the piston 51, it pushes or moves the release mechanism out of its retention hole 52 thus allowing the drive ring surface 45 to strike surface 48 (FIG. 12) formed by drive ring 41 thereby moving the slips out of the slots 18 in housing 16. The biased threads 39 and 55 in mandrel 34 and segmented lock nut 54 allow the lock nut to skip over the threads 39, the garter springs 56 expanding to accommodate this step designed to lock the slips 22 in place after they seat against the pipe casing 7.

FIG. 13 shows the base cap 36 threadably secured to the end of the central mandrel 34. The cap 36 is attached to the end of the housing 16 by one or more shear bolts or pins 72. The shear pin 70 secures the plunger 60 in the extended position and serves to prevent the plunger from being inadvertently actuated while the mechanical set anchor mechanism 14 is being tripped into the borehole. As mentioned before. when the end 62 of the plunger 60 contacts the bridge plug or packer assembly 78 the shear pin breaks allowing the anchor to be actuated against the pipe casing 7.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A borehole sidetracking apparatus consisting of a whipstock assembly that includes a window starter mill attached to an end of the whipstock through a shear bolt connected to a shear bolt block affixed to the end of a ramp face formed by the whipstock and a compression setting anchor connected to the bottom of the whipstock, a means to increase the anchor set of one or more slips extended from the anchor into a wall formed in the borehole after the window starter mill is sheared from the whipstock through an increase of compressive loads comprising;

a ledge formed near an end of the window starter mill, the ledge being spaced from and substantially aligned with a shoulder formed by the shear bolt block attached to the end of the whipstock, when the shear bolt breaks, the ledge extending from the window starter mill strikes the shoulder of the shear bolt block with considerable force thereby setting the slips extending from the anchor more securely in the borehole.

2. The invention as set forth in claim 1 wherein the borehole adjacent the sidetracking apparatus is lined with a pipe casing.

3. The invention as set forth in claim 2 wherein said pipe casing is steel.

4. The invention as set forth in claim 3 wherein the shoulder of the shear bolt block further serves to prevent the window starter mill from jamming between the ramped surface face of the whipstock and a wall formed by the steel pipe casing when the window starter mill is released under compressive loads.

5. A method to further set a compression set type anchor positioned and set in a pipe casing after a window starter mill connected to a whipstock assembly that includes the anchor is released by increasing the compression force on a shear pin placed through an end of the window starter mill and attached to a shear bolt block affixed to a face formed by the whipstock comprising the steps of;

forming a ledge on an end of the window starter mill that is spaced from, positioned above and substantially aligned with the shear bolt block, forming a shoulder on the shear bolt block that is adjacent to the ledge on the window starter mill, the shoulder acting as a stop for the ledge formed on the window starter mill when the shear bolt shears under increased compression loads, the window starter mill subsequently strikes the shoulder formed by the shear bolt block with considerable force thereby driving one or more slips extending from the anchor into further engagement with the pipe casing.

6. The method as set forth in claim 5 further comprising the steps of;

lifting the separated window starter mill off the shoulder formed by the shear bolt block after the initial strike of the ledge against the shoulder a predetermined distance, and dropping the window starter mill onto the shoulder to further drive the one or more slips extending from the anchor into engagement with the pipe casing, the foregoing steps being repeated as often as necessary to assure secure attachment of the anchor to the pipe casing.

7. The method as set forth in claim 5 further comprising the step of;

preventing the window starter mill from being jammed between the face of the whipstock and the pipe casing after the shear bolt connecting the window starter mill to the whipstock is sheared by providing the ledge on the window starter mill that is aligned with and intercepted by the shoulder formed by the shear bolt block affixed to the face of the whipstock thus preventing the window starter mill from advancing past the bolt block when it is freed from the whipstock.

8. A borehole sidetracking apparatus, comprising:

a) a starter mill assembly having a rotatable starter mill and a downwardly extending lower end which is located below the starter mill;

b) a whipstock having a generally cylindrical lower portion and an upper portion which presents a ramped face and contains a shear bolt block;

c) a shear bolt passing through the shear bolt block and interconnecting the whipstock to the starter mill assembly;

d) an engageable shoulder formed within the whipstock proximate the shear bolt block;

e) a ledge formed within the lower end of the starter mill assembly to engage the shoulder formed within the whipstock to prevent the starter mill from engaging the ramped face upon shearing of the shear bolt.

9. The sidetracking apparatus of claim 8 further comprising a set anchor affixed to the whipstock to secure the whipstock within a borehole.

10. The sidetracking assembly of claim 9 wherein the set anchor comprises a housing with a plunger disposed therein to translate axially therethrough in a telescopic manner.

11. The sidetracking assembly of claim 10 wherein the plunger can be translated into the housing to cause a plurality of slips to engage a borehole wall.

12. The sidetracking assembly of claim 9 wherein the set anchor is caused to be forced into engagement with a borehole wall after shearing of the shear pin by dropping the starter mill assembly onto the whipstock so that the ledge is engaged with the shoulder.

13. A borehole sidetracking apparatus, comprising:

a) a starter mill assembly having a rotatable starter mill and a downwardly extending lower end;

b) a whipstock having a generally cylindrical lower portion and an upper portion which presents a ramped face;

c) a shear means interconnecting the whipstock to the starter mill assembly;

d) interengageable shoulders formed on the starter mill assembly and whipstock for preventing the starter mill from moving below the shoulder formed on the whipstock and becoming wedged between the ramped face of the whipstock and a borehole wall.

14. The borehole sidetracking apparatus of claim 13 further comprising an anchor affixed to the whipstock for anchoring the whipstock within a portion of a borehole.

* * * * *